US005816871A

United States Patent [19]

Proverbio

[11] Patent Number: 5,816,871

[45] Date of Patent: Oct. 6, 1998

[54] MUSCLE-POWERED WATERCRAFT

[76] Inventor: Rodolphe Proverbio, Bateau Vive la Vie 31, rue Charles Michel, F77400 Lagny, France

[21] Appl. No.: 500,947

[22] PCT Filed: Dec. 5, 1994

[86] PCT No.: PCT/FR94/01412

§ 371 Date: Nov. 17, 1995

§ 102(e) Date: Nov. 17, 1995

[87] PCT Pub. No.: WO95/15882

PCT Pub. Date: Jun. 15, 1995

[30] Foreign Application Priority Data

Dec. 6, 1993 [FR] France ..... 93 14695

[51] Int. Cl.[6] ..... B63H 16/00

[52] U.S. Cl. ..... 440/22; 440/14

[58] Field of Search ..... 440/13–15, 21, 440/22, 9, 10; 114/121, 124, 125; 441/65, 74, 75, 76

[56] References Cited

U.S. PATENT DOCUMENTS

| | | | |
|---|---|---|---|
| 2,195,527 | 4/1940 | Whiting | 440/21 |
| 3,384,910 | 5/1968 | Heston, Jr. et al. | 441/65 |
| 3,557,735 | 1/1971 | Dreyfus | 114/124 |
| 3,718,109 | 2/1973 | Skitsko | 440/22 |
| 3,833,956 | 9/1974 | Meehan | 440/14 |
| 4,371,347 | 2/1983 | Jakobsen | 440/13 |

FOREIGN PATENT DOCUMENTS

| | | | |
|---|---|---|---|
| 2128898 | 10/1972 | France . | |
| 2059143 | 6/1971 | Germany . | |
| 2258044 | 7/1973 | Germany | 440/22 |
| 3121328 | 12/1982 | Germany . | |
| 8414746.6 | 9/1985 | Germany . | |
| 8811637.9 | 12/1988 | Germany . | |
| 4031336 | 4/1992 | Germany . | |
| 4212920 | 10/1993 | Germany . | |

OTHER PUBLICATIONS

"Catamaran Wiggles Through the Water Like a Fish", Popular Mechanics, No. 122, Sep. 1964 p. 97.

*Primary Examiner*—Ed L. Swinehart
*Attorney, Agent, or Firm*—Cushman Darby & Cushman IP Group of Pillsbury Madison & Sutro LLP

[57] ABSTRACT

A muscle-powered watercraft includes flotation and propulsion structure having at least two blades which remain rigid under the stresses that are subjected to. The front edges of the blades are hinged about respective axes transverse to the watercraft's axis of propulsion, spaced from one another along the axis of propulsion on either side of the watercraft's center of gravity. Each of these blades extends symmetrically from the axis of propulsion. Abutment structure limits the angle of freedom of each blade about its hinging axis, and the volume of water displaceable by immersion of the flotation structure is selected to correspond to 1 to 2 times the total laden weight of the watercraft. The flotation structure has feet-supporting surfaces distributed about the craft's center of gravity, whereby a driver may impart to the watercraft a sinusoidal movement in and out of the water by pitching the craft and hence making the blades operate in opposition to one another between the abutments.

9 Claims, 3 Drawing Sheets

Fig. 5
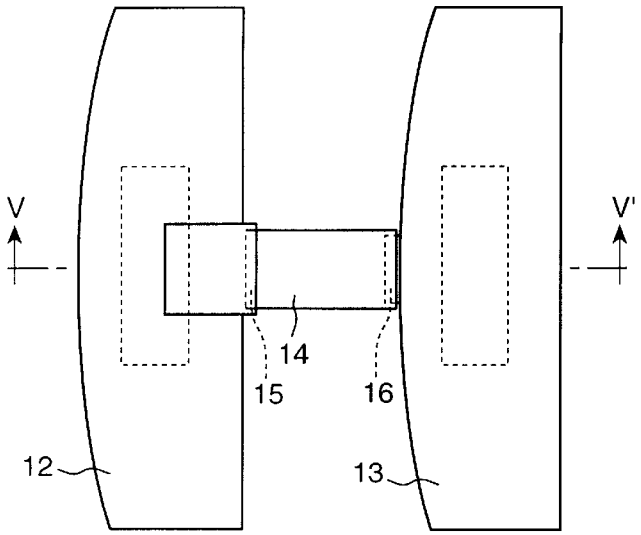
Fig. 7a
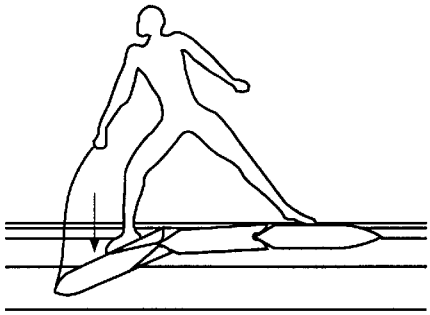
Fig. 7b
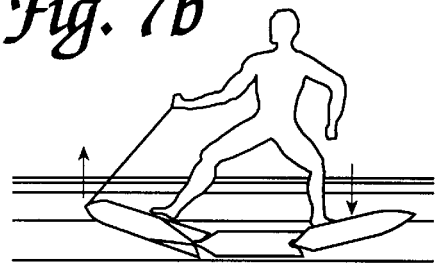
Fig. 6
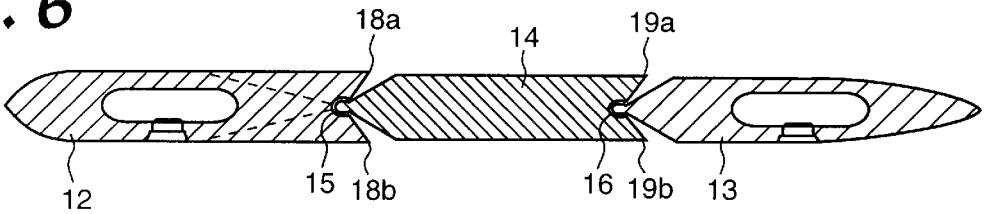
Fig. 8a
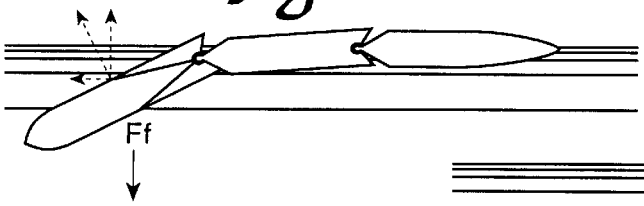
Fig. 8b
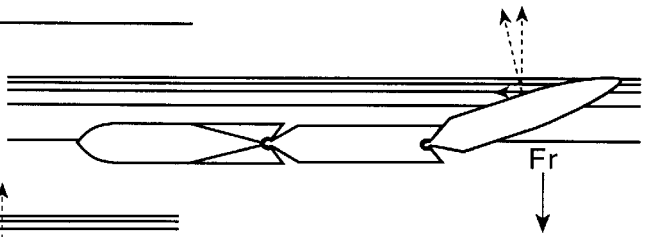
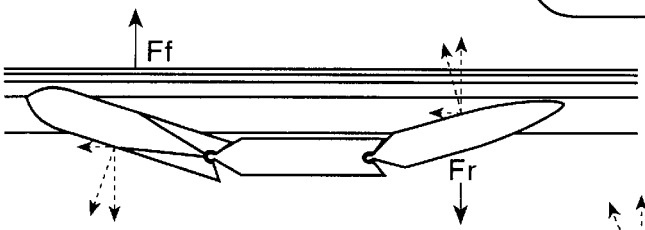
Fig. 8c
Fig. 8d
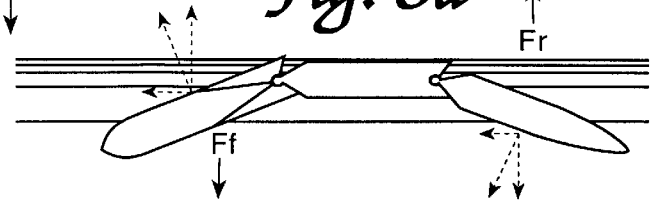

MUSCLE-POWERED WATERCRAFT

BACKGROUND AND SUMMARY OF THE INVENTION

The present invention relates to a muscle-powered watercraft comprising flotation means and propulsion means having at least two blades. These blades may be made of a single part or in certain cases of two parts joined rigidly together by a common axle so that they can be considered as constituting a single blade having two parts.

Many watercraft of this type are known, at least from the literature. However none of them can be considered as a commercial success because the energy efficiency is low and the movement to be performed makes hard work, so the public instead prefers more conventional watercraft such as rowing boats or pedalos.

The research leading to the present invention has been directed to three points: firstly a play-like, sporting, balancing movement which can develop a feeling for water; secondly a substantial improvement of the energy efficiency; and lastly an original mode of operation which consists in causing the watercraft to plunge in and then out of the water with a constantly-propulsive sinusoidal trajectory.

To this end, the invention concerns a muscle-powered watercraft comprising flotation and propulsion means having at least two blades which remain rigid under the stresses they are subjected to, characterized in that the front edges of the blades are hinged about respective axes transverse to the watercraft's axis of propulsion, spaced from one another along said axis of propulsion on either side of the watercraft's center of gravity, each of these blades extending symmetrically from said axis of propulsion, there being abutment means for limiting the angle of freedom of each blade about its hinging axis, and the volume of water displaceable by immersion of said flotation means being selected to correspond to 1 to 2 times, preferably 1.2 to 1.5 times, the total laden weight of the watercraft, said flotation means having feet-supporting surfaces arranged about the craft's center of gravity, whereby a driver may impart to the watercraft a sinusoidal movement in and out of the water by pitching the craft and hence make the blades operate in opposition to one another between said abutments.

The advantage of this watercraft comes from two elements which in combination enable a substantial improvement of the propulsion energy. One of these elements is the use of rigid blades freely hinged between two abutments, which is a simple and efficient system. The other is the use of flotation means which, in response to a pitching movement communicated to the watercraft, allow the watercraft to adopt a sinusoidal movement in and out of the water. Due to this movement, the two blades situated on either side of the watercraft's center of gravity operate in phase opposition but produce forces directed alternately upwards or downwards and each having a component in the direction of propulsion. The sine may have a substantial amplitude so that the idle movements during which the phase inversion of these blades tipping from one abutment to the other represents only a small proportion of the total propulsive movement. In any event, this tipping phase of the blades does not constitute a loss of efficiency because at that moment the downwardly- or upwardly-acting vertical force is in a no-load situation; only a small fraction of the force is needed to produce the tipping itself. As there is no resistance, the speed of the movement increases and when it reaches the abutment at greater speed, the force is restituted. Moreover, each user may adjust the degree of flotability of his watercraft as a function of his own weight and muscular force, which enables the production of sinusoidal movements in and out of the water of greater or smaller amplitude.

BRIEF DESCRIPTION OF THE DRAWINGS

The accompanying drawings show, schematically and by way of example, three embodiments of the watercraft according to the invention.

FIG. 5 is a plan view of a second embodiment.

FIG. 6 is a cross-sectional view along line V–V' of FIG. 5.

FIGS. 7*a* and 7*b* are elevational views of the watercraft carrying a driver, in the two pressure-applying phases.

FIGS. 8*a* to 8*d* are four elevational views of the watercraft of FIG. 5 showing different phases of the sinusoidal movement.

DETAILED DESCRIPTION OF THE INVENTION

Figure 1:
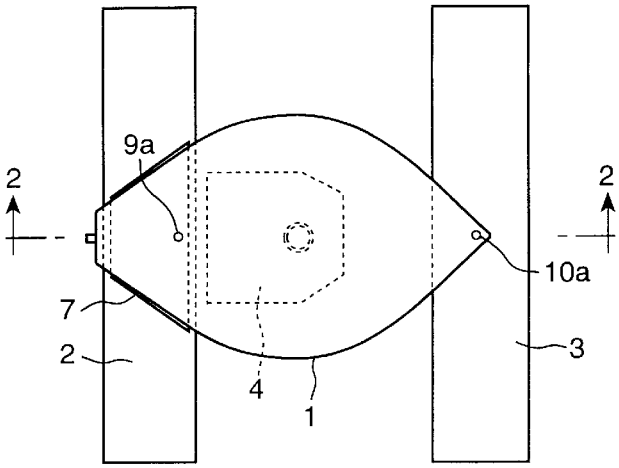
FIG. 1 is a plan view of a first embodiment.
Figure 3:
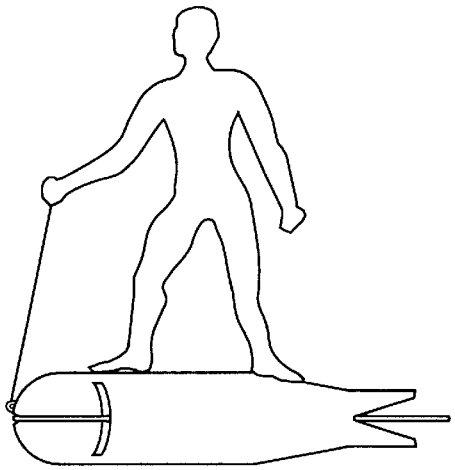
FIG. 3 is an elevational view of the watercraft carrying a driver.
Figure 2:
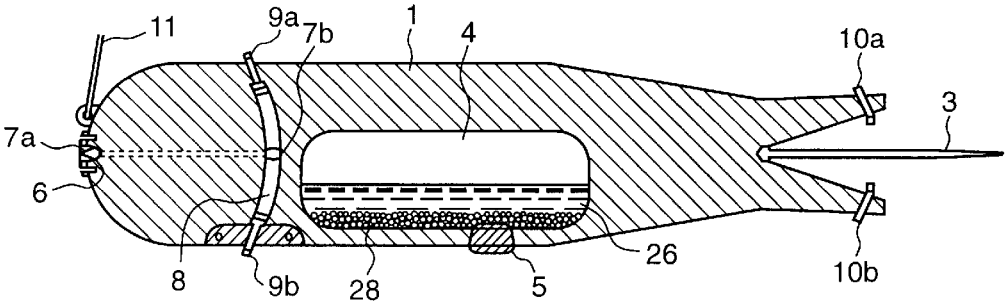
FIG. 2 is a view in longitudinal cross-section along line AA' of FIG. 1.

FIGS. 1 and 2 illustrate a watercraft comprising a central float 1 to which are pivotally mounted two blades 2 and 3 by their respective front edges. These blades extend transversally and are situated respectively in front of and behind the watercraft's center of gravity. In FIG. 2, the pivoting axes of the forward and rear blades are shown situated on the central longitudinal axis of the float, but these axes could be off such alignment, in particular they can be lowered so that these blades remain submerged during operation to avoid "cavitation" phenomena.

The float encloses a free space 4 accessible by means of an obturator 5 which allows adjustment of the watercraft's degree of flotability by using a suitable ballast such as water.

The ballast is preferably formed of a liquid phase 26, a divided particulate solid phase preferably in the form of pellets 28, or a mixture of the two. This enables two functions to be achieved. One function is to adjust the watercraft's flotability. The other, by means of the mobility of the ballast accompanying the watercraft's oscillating movement, is to amplify this movement hence reduce the muscular effort or increase its output by free movement of the ballast in the free space 4, under its inertia. Of course, the shape and volume of the space 4 can be selected with a view to amplifying the ballast's inertia effect. Thus, this shape and volume can be designed to create zones able to control the flow of liquid or pellets or their mixture inside the volume to maximize conversion of the inertia effect into a propulsive movement of the watercraft. The mass of the ballast can be adjusted as a function of the desired performance of the watercraft. Ballast can be added with a view to covering long distances at reduced muscular effort. Ballast can be removed to make the watercraft easier to control.

The blades have a density about the same as water so that when submerged they neither rise nor sink on their own. The front blade 2 has a cut-out 7 whose front end 7*a* serves as pivoting axis and engages in a groove 6 provided at the front end of the float and whose rear end 7*b* can be formed by a rod fitting in an arcuate opening 8. Two abutments 9*a* and 9*b* formed for example by adjustable screws limit the angle of pivoting of the blade 2. Any other arrangement for the same purpose may be envisaged, notably dispensing with the arm 7*b* and the opening 8. In such a case, the abutments could be formed by lateral projections provided on the float. The groove 6 can be a hole.

The rear blade 3 is pivotally mounted between two adjustable abutments 10*a* and 10*b* fixed on the central float 1.

As regards the blades, we have tested other possibilities than that described above. Such possibilities include the use of materials of controlled elasticity which can be advantageous notably as regards less abrupt navigation of the watercraft, but the energy output is not so good because any elastic system consumes part of the energy it receives.

Spring-loaded blades: for these blades, which are rigid and pivoted as previously, the abutments are replaced by biasing return springs or elastic blocks, wound around the pivoting axis or directly connecting the blades to the float. Such blades are horizontal at rest and pivot under the action of vertical forces Ff and Fr, compressing the springs and adopting approximately the same propulsive positions that they previously had against the abutments. During the next phase, the springs restitute a part of the stored force.

Semi-rigid elastic blades: these blades deform elastically in response to transverse pressure and their flexibility increases from front to rear. These blades can be of a composite reinforcing fiber/polymeric material having fiber layers decreasing from the front to the rear, but may also be made of any elastic material having a tapered profile and an appropriate modulus of elasticity.

Such blades can be pivoted between two abutments or can be fixed, in which case their front edge no longer pivots and their progressive elastic profile is calculated so that the rear part adapts a suitable propulsive inclination in response to vertical thrusts Ff and Fr.

The watercraft's degree of flotability is adjusted between 1 and 2, i.e. so that the volume of water displaced is from 1 to 2 times the watercraft's laden weight, preferably between 1.2 and 1.5 depending on the user's muscular strength and the desired degree of submersion.

Figure 4A:
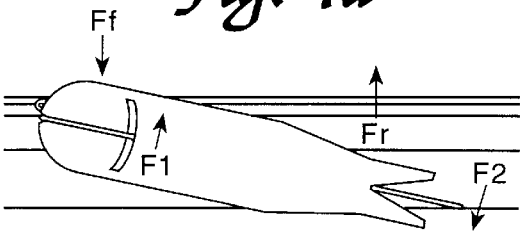
FIGS. 4*a* to 4*d* are side elevational views of this watercraft showing four phases of the sinusoidal movement in the water.

FIG. 4*a* shows the submerged watercraft at the peak of its sinusoidal movement where the blades 2 and 3 change position, the blade 2 pivoting in the direction of arrow F1 and blade 3 in the direction of arrow F2. This is the upper idle time of the sinusoidal movement.

Figure 4B:
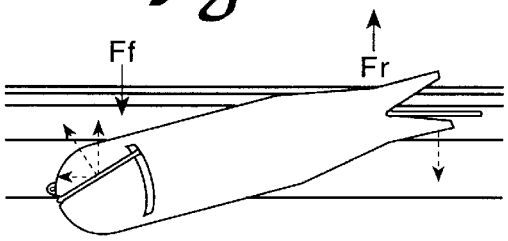

FIG. 4*b* shows the sinking sinusoidal movement, where the blades 2 are against their upper and lower abutment respectively. Each blade produces a force perpendicular to its plane with a component in the direction of propulsion. The magnitude of this component increases with the angle that the blade makes to the direction of propulsion.

Figure 4C:
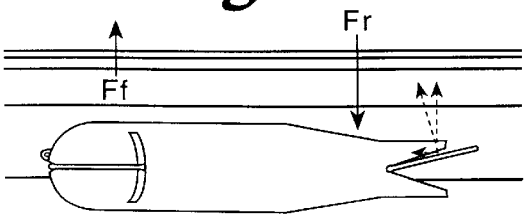

FIG. 4*c* shows the perigee (low point) of the sinusoidal movement at the moment when the blade 2 pivots clockwise towards the lower abutment while the rear blade has already pivoted against the upper abutment and exerts its thrust. It can thus be seen that the idle or dead points of the two blades do not coincide exactly so that the watercraft practically constantly is thrusted forwards.

Figure 4D:
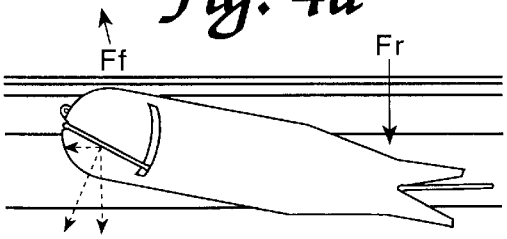

Lastly, FIG. 4*d* shows the watercraft in the upward phase of the sinusoidal movement where the two blades 2 and 3, working in phase opposition, generate two propulsive forces which add together.

Of course, the sinusoidal movement of the watercraft is generated by alternately applying and removing the weight of the driver's body where indicated by arrows Ff and Fr, which are directed alternately downwards or upwards according to whether the driver applies his full weight onto a point and pushes it down, or while alternately applying his weight on another point the first point moves up under the effect of the Archimedes thrust and the lever effect due to the fact that the flotability is greater than 1 and preferably greater than 1.2.

The driver can hold onto a cord 11 secured to the front of the watercraft. To steer, the driver displaces the points of application of the forces relative to the longitudinal axes A–A' by causing these application points to pivot about the center of gravity in the clockwise direction to turn left, and in the counter-clockwise direction to turn to the right, changing the direction of thrust of the blades 2 and 3 relative to the longitudinal axis A–A'.

In practice, it is not necessary to displace the rear foot except when the front foot is angularly displaced by such a large amount that the driver could no longer remain in equilibrium on the float.

The watercraft's turning radius depends on the angle of displacement of the foot or the feet. The more the front foot is eccentric to the longitudinal axis, the more the blades 2 and 3 are inclined and cause the bow to chop, hence the turn is tighter. Moreover, by exercising a strong pressure on the front foot angularly offset to the longitudinal axis A–A', the rear blade 3 is made to rise more or less out of the water so that it no longer stabilizes the direction of the watercraft, which enables the watercraft to be practically rotated about itself through a desired angle.

It should be noted that for steering, the position of the pivoting axis 6 of the front blade is very important. The more this axis is forward in the longitudinal direction, the more the blade is propulsive, but the more difficult it becomes to make a turn. To the contrary, the closer this axis is to the center of gravity, the less propulsive is the blade, whereas making turns is easier.

In the vertical direction, the closer this axis is to the longitudinal axis passing through the center of gravity, the more stable is the watercraft, but it is then difficult to incline the blades laterally to make turns. To the contrary, if the axis is lowered, stability decreases but making turns is easier.

The second embodiment of watercraft according to FIGS. 5 to 8 differs principally from the previous one due to the fact that the floatation element is basically made up of the blades 12 and 13 themselves, the element 14 connecting them being provided with transverse hinges 15 and 16 for the two blades 12 and 13. As in the previous embodiment, the two abutments 18*a*, 18*b*; 19*a*, 19*b* limit the amplitude of swing the blades 12 and 13.

These abutments can be replaced by return biasing spring systems whose force is so calculated that the blades 12 and 13 adopt approximately the same propulsive angle that they would have against the abutments during the vertical thrusts Ff and Fr.

Ballast is also provided in each blade for adjustment of the watercraft's flotability according to the driver's weight.

Steering is achieved in the same way as before.

Propulsion is according to the same principle as for the first embodiment, as can be appreciated from FIGS. 8 to 8*d* which require no further explanation.

Figure 9:
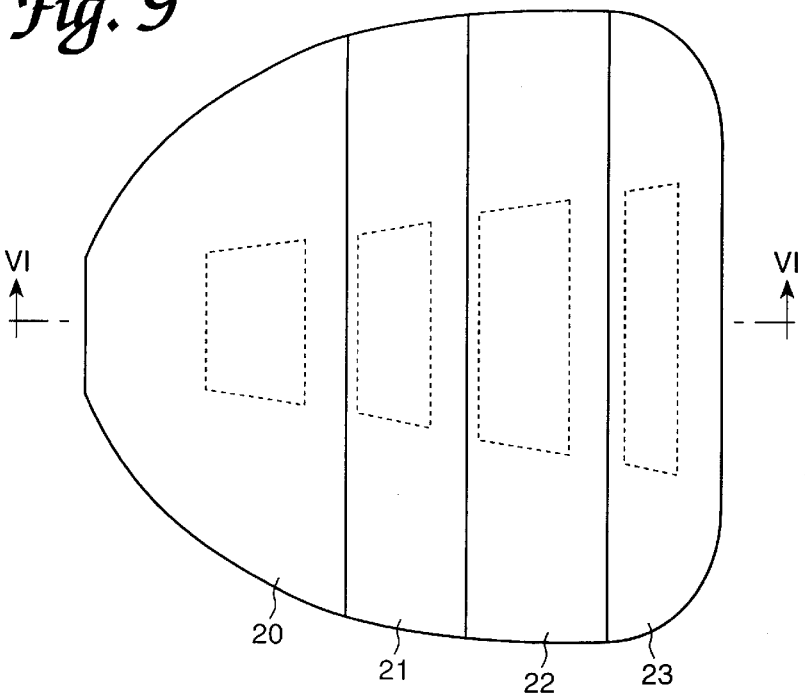
FIG. 9 shows a third embodiment.
Figure 10:
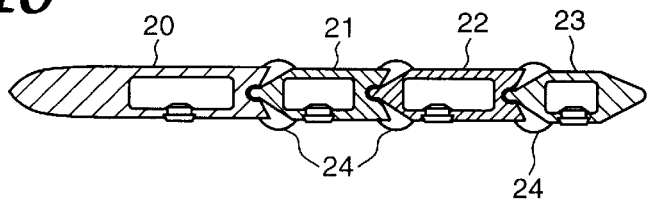
FIG. 10 is a cross-sectional view along line VI—VI of FIG. 9.
Figure 11A:
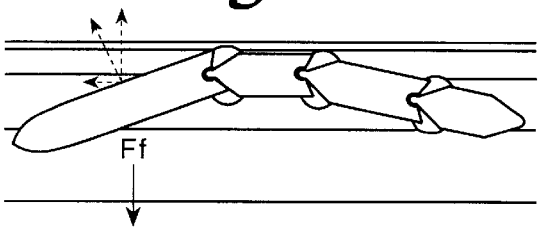
FIGS. 11*a* to 11*d* are four elevational views of the watercraft of FIG. 9 showing different phases of the sinusoidal movement.
Figure 11B:
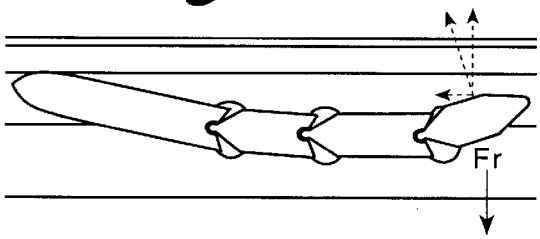
Figure 11C:
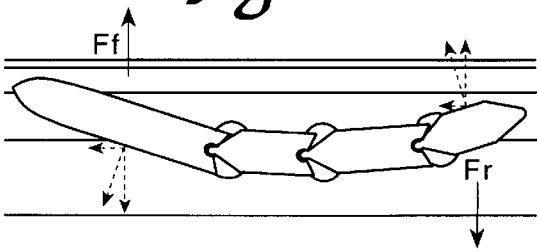
Figure 11D:
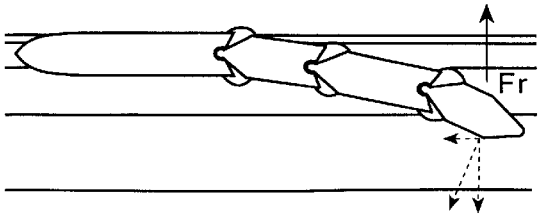

Lastly, the embodiment of FIGS. 9, 10 and 11 includes a sort of floating carpet made up of four float elements 20, 21, 22, 23 hinged to one another with limited degrees of freedom relative to one another.

Because there are more than three hinged elements and therefore it is not possible with two feet to control all of them, it is necessary to ensure that the floating carpet cannot have adopt a blocked position in which propulsion is neutralized. In this case, to prevent such a situation from occurring, above and below the hinges spring blades 24 are provided to tend to hold hinged-together pairs of elements relative to one another. FIGS. 11*a* to 11*d* show the different phases after sinusoidal movement and the resulting propulsive forces.

It must also be noted that the shape and the length of the float play a part in the watercraft's handling.

For each model, the best hydrodynamics is sought and as the volume of the watercraft is related to the driver's weight, each model will be available in several sizes.

For example, in the first embodiment, for a driver weighing 60/70 kg, the float can be about 1.8 m long, 50 cm wide mid-craft, and maximum thickness 28 cm for a volume of 100 liters. The front blade surface is about 0.5 $m^2$. The rear blade surface about 0.25 $m^2$.

All of these figures can vary in wide proportions according to the aim sought: speed, stability, sporting movement.

Moreover, it is advantageous to provide a non-slip support for the feet on the float. For this purpose, a non-skid coating could be applied, and the float fitted with binding straps.

Of course, the feet-supporting face of the float will be designed to allow angular displacement of the feet in order to steer and propel the watercraft as explained above.

I claim:

1. A muscle powered watercraft comprising:

flotation structure having a floating member with feet supporting surfaces distributed about a center of gravity of the watercraft, the volume of said floating member being selected to correspond to one to two times the total laden weight of the watercraft, means for propelling said floating member along an axis of propulsion, said propelling means having at least two blades which remain rigid under stresses they are subjected to, front edges of the blades being hinged about respective fixed axes transverse to the watercraft's axis of propulsion, spaced from one another along said axis of propulsion on either side of the watercraft's center of gravity, each of the blades extending symmetrically from said axis of propulsion, the density of the blades being about that of water, and abutment means for limiting an angle of freedom of each blade about its hinging axis, and allowing each blade to convert a vertical force into a propulsion force, said feet supporting surfaces being distributed in such a manner as to enable variation of the angle of propulsion of the blades relative to the watercraft's longitudinal axis, said watercraft being constructed and arranged such that a driver may impart to the watercraft a sinusoidal movement in and out of the water by pitching the watercraft and hence making the blades operate in opposition to one another against said abutments.

2. A watercraft according to claim 1, further comprising means for varying a degree of floatation of the watercraft.

3. A watercraft according to claim 1, wherein the blades are hinged to a central element.

4. A watercraft according to claim 2, wherein said varying means are constituted by a liquid phase arranged in a volume greater than that of said liquid phase and shaped to permit the flow thereof under the pitching effect communicated to said flotation structure.

5. A watercraft according to claim 2, wherein said varying means are constituted by a solid phase formed of pellets arranged in a volume greater than that of said solid phase and shaped to permit the flow thereof under the pitching effect communicated to said flotation structure.

6. A watercraft according to claim 2, wherein said means are constituted by a mixture of a liquid phase and a solid phase formed of pellets, arranged in a volume greater than that of said liquid and solid phase and shaped to permit the flow thereof under the pitching effect committed to said floatation structure.

7. The water craft according to claim 1, wherein said flotation structure is selected to correspond to 1.2 to 1.5 times the total laden weight of the watercraft.

8. The watercraft according to claim 1, wherein the surface of the front blade is larger than that of the rear blade.

9. The watercraft according to claim 1, wherein the pivoting axis of the front blade is positioned with respect to the center of gravity so as to enhance turning of the watercraft.

* * * * *